US010359020B2

(12) United States Patent
Shiraishi

(10) Patent No.: US 10,359,020 B2
(45) Date of Patent: Jul. 23, 2019

(54) IGNITION CONTROL APPARATUS AND IGNITION CONTROL METHOD

(71) Applicant: SHINDENGEN ELECTRIC MANUFACTURING CO., LTD., Chiyoda-ku, Tokyo (JP)

(72) Inventor: Shinji Shiraishi, Hanno (JP)

(73) Assignee: SHINDENGEN ELECTRIC MANUFACTURING CO., LTD., Tokyo (JP)

( * ) Notice: Subject to any disclaimer, the term of this patent is extended or adjusted under 35 U.S.C. 154(b) by 345 days.

(21) Appl. No.: 14/763,959

(22) PCT Filed: Mar. 25, 2013

(86) PCT No.: PCT/JP2013/058560
§ 371 (c)(1),
(2) Date: Jul. 28, 2015

(87) PCT Pub. No.: WO2014/155484
PCT Pub. Date: Oct. 2, 2014

(65) Prior Publication Data

US 2015/0369203 A1 Dec. 24, 2015

(51) Int. Cl.
*F02P 7/077* (2006.01)
*F02P 5/15* (2006.01)
(Continued)

(52) U.S. Cl.
CPC ..... *F02P 7/077* (2013.01); *F02P 3/045* (2013.01); *F02P 3/0435* (2013.01); *F02P 5/151* (2013.01)

(58) Field of Classification Search
CPC ..... F02P 1/083; F02P 3/0407–3/0442; F02P 3/45–3/0453; F02P 3/055–3/0552;
(Continued)

(56) References Cited

U.S. PATENT DOCUMENTS 3,911,886 A * 10/1975 Nagasawa ..... F02P 7/03 123/599
4,116,188 A * 9/1978 Nagasawa ..... F02P 1/086 123/603
(Continued)

FOREIGN PATENT DOCUMENTS

JP 58-191382 U 12/1983
JP 62023570 A * 1/1987
(Continued)

OTHER PUBLICATIONS

International Search Report for PCT/JP2013/058560, dated Apr. 23, 2013, 4 pages.
(Continued)

*Primary Examiner* — John M Zaleskas
(74) *Attorney, Agent, or Firm* — Nixon & Vanderhye P.C.

(57) ABSTRACT

An ignition control apparatus according to one embodiment of the present invention is an ignition control apparatus which generates, in an ignition coil, a voltage to be supplied to a spark plug that is provided in an internal combustion engine on the basis of a pulse signal induced in the ignition coil of the internal combustion engine, wherein the ignition control apparatus comprises at least a switch element for passing current through and discharge the ignition coil, and a controlling unit that acquires the timing for discharge the ignition coil in response to a first pulse of the pulse signal, and controls the switch element so that a current flows through the ignition coil in response to a second pulse that follows the first pulse and the ignition coil is opened on the basis of the discharge timing acquired in response to the first pulse.

8 Claims, 9 Drawing Sheets

(51) Int. Cl.
*F02P 3/04* (2006.01)
*F02P 3/045* (2006.01)

(58) Field of Classification Search
CPC ..... F02P 5/15; F02P 5/1502; F02P 5/1054; F02P 5/151; F02P 5/1555; F02P 5/1556; F02P 11/02
See application file for complete search history.

(56) References Cited

U.S. PATENT DOCUMENTS 4,404,952 A * 9/1983 Fujimoto ..... F02P 1/086 123/406.57
4,509,493 A * 4/1985 Nash ..... F02P 1/086 123/406.57
4,553,427 A * 11/1985 Kuraoka ..... F02P 5/1506 123/406.54
4,566,425 A * 1/1986 Nitou ..... F02P 1/086 123/406.57
4,624,234 A * 11/1986 Koketsu ..... F02P 1/086 123/406.57
4,627,398 A * 12/1986 Koike ..... F02P 3/0453 123/406.66
4,643,150 A * 2/1987 Miura ..... F02P 3/0838 123/406.66
4,924,831 A * 5/1990 Piteo ..... F02P 1/086 123/406.57
5,069,193 A * 12/1991 Erhard ..... F02P 1/086 123/335
5,105,794 A * 4/1992 Fukuda ..... F02P 1/083 123/149 D
5,111,798 A * 5/1992 Notaras ..... F02P 1/083 123/149 D
6,761,148 B2 * 7/2004 Kiessling ..... F02D 37/02 123/149 D
6,766,787 B2 * 7/2004 Kihlberg ..... F02P 3/04 123/149 D
6,814,055 B2 * 11/2004 Kihlberg ..... F02P 1/083 123/149 D
2003/0029420 A1 * 2/2003 Uemura ..... F02N 99/004 123/406.57
2003/0178005 A1 9/2003 Fewell et al.
2004/0154592 A1 * 8/2004 Fujima ..... F02P 3/0838 123/406.57
2004/0255901 A1 * 12/2004 Yamashita ..... F02P 1/086 123/335
2006/0169249 A1 8/2006 Shimoyama et al.
2008/0011272 A1 * 1/2008 Bengtsson ..... F02P 1/086 123/406.56
2010/0095932 A1 * 4/2010 Nakauchi ..... F02P 1/086 123/406.18
2012/0255530 A1 * 10/2012 Olsson ..... F02P 3/0414 123/644
2015/0122239 A1 * 5/2015 Tojo ..... F02P 3/0453 123/609

FOREIGN PATENT DOCUMENTS

JP 64-25473 U 2/1989
JP 03130575 A * 6/1991 ..... F02P 5/15
JP 2005-307761 11/2005
JP 2006-328959 12/2006
JP 2007309201 A * 11/2007
JP 2009156203 A * 7/2009
JP 2010180854 A * 8/2010
JP 2012007577 A * 1/2012
JP 2012-229654 11/2012
WO WO 2008/006594 A2 1/2008
WO WO 2013/038697 A1 3/2013
WO WO 2013038697 A1 * 3/2013 ..... F02P 1/08

OTHER PUBLICATIONS

Written Opinion of the ISA for PCT/JP2013/058560, dated Apr. 23, 2013, 5 pages.
Extended European Search Report dated Jan. 29, 2018 in European Application No. 13880232.7 (9 pages).

* cited by examiner

IGNITION CONTROL APPARATUS AND IGNITION CONTROL METHOD

This application is the U.S. national phase of International Application No. PCT/JP2013/058560 filed 25 Mar. 2013, which designated the U.S., the entire contents of which is hereby incorporated by reference.

TECHNICAL FIELD

The present invention relates to an ignition control apparatus and an ignition control method for an internal combustion engine.

BACKGROUND ART

As a kind of induction-discharge-type ignition control apparatuses for single internal combustion engines, so-called transistor-magneto-type ignition control apparatuses are known (Patent Document 1). This type of ignition control apparatus operates using, as a power supply, the electric power generated by an ignition coil along with rotation of an internal combustion engine, and controls initiation and termination (discharge) of energization of the ignition coil based on a pulse signal generated by the ignition coil. Then, this type of ignition control apparatus applies to a spark plug, a high voltage generated at the time of termination of the energization of the ignition coil, thereby causing a discharge to occur and thus igniting a fuel-air mixture introduced into a cylinder of the internal combustion engine. This type of ignition control apparatus includes circuit elements, such as a capacitor, a Zener diode, and a transistor, and respective circuit constants thereof are previously set so as to acquire a desired ignition timing.

CITATION LIST

Patent Document

[Patent Document 1] Japanese Patent Application Laid-Open Publication No. 2005-307761

DISCLOSURE OF THE INVENTION

Problems to be Solved by the Invention

According to the above-described prior art, the circuit constants for determining the ignition timing are fixed. For this reason, if a rotational speed of the internal combustion engine is changed, a proper ignition timing might not be acquired. Particularly, as the rotational speed of the internal combustion engine increases, it becomes more difficult to, in each rotation cycle, synchronize the respective control operations of initiation and termination of the ignition coil with the rotational speed of the internal combustion engine, thereby making it more difficult to acquire a proper ignition timing.

The present invention has been made in view of the above circumstances, and it is an object of the present invention to provide an ignition control apparatus and an ignition control method capable of stabilizing the ignition operation even if the rotational speed of the internal combustion engine is changed.

Means for Solving the Problems

According to one aspect of the present invention, a proposed ignition control apparatus is an ignition control apparatus configured to, based on a pulse signal to be induced in an ignition coil along with rotation of an internal combustion engine, cause a voltage to be supplied to an spark plug included in the internal combustion engine, to be generated in the ignition coil. The ignition control apparatus includes at least: a switch element configured to energize and discharge the ignition coil; and a control unit configured to acquire, in response to a first pulse of the pulse signal, a discharge timing of the ignition coil, and control the switch element so as to energize the ignition coil in response to a second pulse following the first pulse, and discharge the ignition coil based on the discharge timing acquired in response to the first pulse.

According to one aspect of the present invention, for example, the control unit is configured to determine whether an energization timing and a discharge timing of the ignition coil are reversed. The control unit is configured to, in a case that a result of the determination is negative, control the switch element so as to discharge the ignition coil based on the discharge timing acquired in response to the first pulse. Additionally, the control unit is configured to, in a case that a result of the determination is positive, control the switch element so as to discharge the ignition coil based on a predetermined timing.

According to one aspect of the present invention, for example, the control unit is configured to, in a case that the discharge timing of the ignition coil is after the energization timing, determine that the discharge timing and the energization timing of the ignition coil are not reversed. Additionally, the control unit is configured to, in a case that the discharge timing of the ignition coil is before the energization timing, determine that the discharge timing and the energization timing of the ignition coil are reversed.

According to one aspect of the present invention, for example, the control unit is configured to, in a case that the discharge timing of the ignition coil is within a processing period for controlling initiation of energization of the ignition coil, determine that the discharge timing and the energization timing of the ignition coil are conflicting.

According to one aspect of the present invention, for example, the control unit is configured to, in a case that it is determined that the discharge timing and the energization timing of the ignition coil are conflicting, control the switch element so as to discharge the ignition coil while regarding a timing at or after a trailing edge of the second pulse as the predetermined timing.

According to one aspect of the present invention, a proposed ignition control apparatus is an ignition control apparatus configured to, based on a pulse signal to be induced in an ignition coil along with rotation of an internal combustion engine, cause a voltage to be supplied to an spark plug included in the internal combustion engine, to be generated in the ignition coil. The ignition control apparatus includes at least: a power generation unit configured to generate from the pulse signal to be induced to the ignition coil, a power supply voltage required to operate the ignition control apparatus; a first polarity pulse signal detection unit configured to detect from the pulse signal to be induced to the ignition coil, a first pulse of a first polarity; a second polarity pulse signal detection unit configured to detect from the pulse signal to be induced to the ignition coil, a second pulse of a second polarity following the first pulse; a switch element configured to energize and discharge the ignition coil; a control unit configured to acquire a rotational speed of the internal combustion engine in response to the first pulse, determine whether or not the rotational speed of the internal combustion engine is equal to or greater than a predetermined value, in a case that the rotational speed of the internal combustion engine is equal to or greater than the predetermined value, acquire a discharge timing of discharging the ignition coil, and output an ignition control signal for controlling the switch element so as to energize the ignition coil in response to the second pulse following the first pulse, and discharge the ignition coil based on the discharge timing acquired in response to the first pulse; and a driver unit configured to drive the switch element based on the ignition control signal.

According to one aspect of the present invention, for example, the control unit includes: a rotational speed acquisition unit configured to acquire the rotational speed of the internal combustion engine based on the first pulse generated by the first polarity pulse signal detection unit; a rotational speed determination unit configured to determine whether or not the rotational speed of the internal combustion engine acquired by the rotational speed acquisition unit is equal to or greater than the predetermined value; an ignition timing acquisition unit configured to, in a case that a result of the determination by the rotational speed determination unit is positive, acquire and output a discharge timing of the ignition coil based on the first pulse; a state determination unit configured to determine whether an energization timing and a discharge timing of the ignition coil are reversed; and an ignition control signal generation unit configured to generate the ignition control signal so as to initiate energization of the ignition coil in response to the second pulse, and terminate the energization of the ignition coil based on the discharge timing output from the ignition timing acquisition unit. The ignition timing acquisition unit is configured to, in a case that a result of the determination by the state determination unit is negative, maintain and output the discharge timing acquired based on the first pulse. Additionally, the ignition timing acquisition unit is configured to, in a case that a result of the determination by the state determination unit is positive, acquire and output a predetermined timing in place of the discharge timing acquired based on the first pulse. The ignition control signal generation unit is configured to, in a case that the discharge timing comes before the determination by the state determination unit, generate the ignition control signal so as to initiate energization of the ignition coil at the discharge timing.

According to one aspect of the present invention, for example, the control unit is configured to, in a case that the rotational speed of the internal combustion engine is smaller than the predetermined value, control the switch element so as to energize and discharge the ignition coil in response to the second pulse.

According to one aspect of the present invention, a proposed ignition control method is an ignition control method of, based on a pulse signal to be induced in an ignition coil along with rotation of an internal combustion engine, causing a voltage to be supplied to an spark plug included in the internal combustion engine, to be generated in the ignition coil. The ignition control method includes at least control steps of: acquiring a discharge timing of the ignition coil in response to a first pulse of the pulse signal; and energizing the ignition coil in response to a second pulse following the first pulse, and discharging the ignition coil based on the discharge timing acquired in response to the first pulse.

EFFECTS OF THE INVENTION

According to one aspect of the present invention, it is possible to stabilize the ignition operation of the ignition coil.

MODE FOR CARRYING OUT THE INVENTION

[Description of Configuration]

Figure 1:
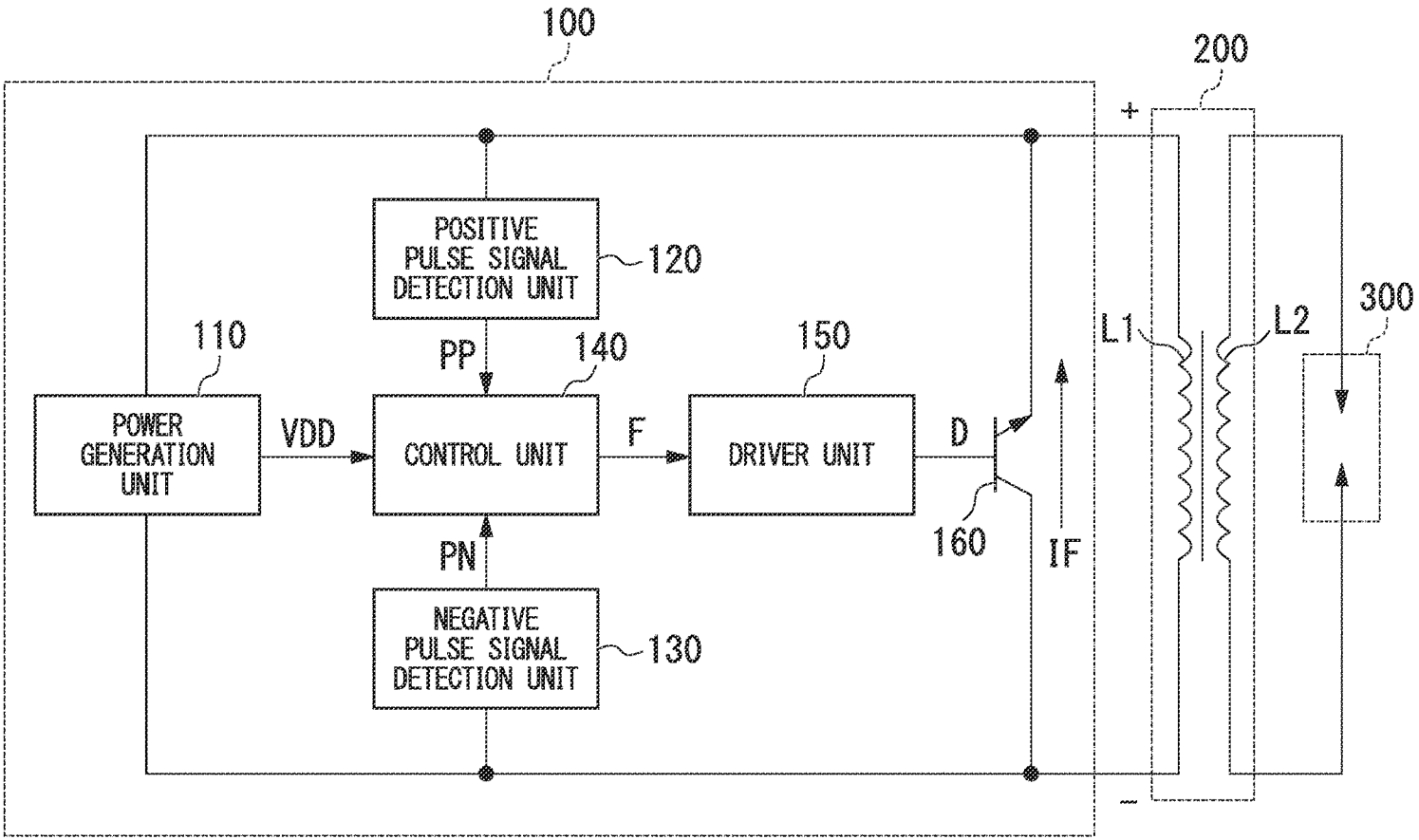
FIG. 1 is a block diagram schematically showing an example of a configuration of an ignition control apparatus according to an embodiment of the present invention.

FIG. 1 is a block diagram schematically showing an example of a configuration of an ignition control apparatus 100 according to an embodiment of the present invention. The ignition control apparatus 100 is configured to, based on a pulse signal acquired from a voltage to be induced in an ignition coil 200 along with rotation of an internal combustion engine not shown, and cause a voltage to be supplied to a spark plug 300 of the internal combustion engine, to be generated in the ignition coil 200. The ignition control apparatus 100 includes a power generation unit 110, a positive pulse signal detection unit (first polarity pulse signal detection unit) 120, a negative pulse signal detection unit (second polarity pulse signal detector) 130, a control unit 140, a driver unit 150, and a switch element 160.

A primary side coil L1 of the ignition coil 200 is connected to an output unit of the ignition control apparatus 100, and the spark plug 300 is connected to a secondary side coil L2 of the ignition control apparatus 100. Additionally, the primary side coil L1 of the ignition coil 200 is disposed adjacent to an outer periphery of a flywheel of the internal combustion engine not shown. The outer periphery of the flywheel is attached with a magnetic plate (not shown) for inducing a pulse signal to the primary side coil L1 of the ignition coil 200. When the internal combustion engine rotates and thus the flywheel rotates, in each rotation cycle, a later-described pulse signal P (FIGS. 5 to 8) including a train of pulses of "positive pulse-negative pulse-positive pulse" is induced in the primary side coil L1 of the ignition coil 200. In the present embodiment, among the train of pulses of "positive pulse-negative pulse-positive pulse" included in the pulse signal P to be induced in the primary side coil L1 of the ignition coil 200 at each rotation cycle, a positive pulse (first polarity pulse) at the head of the train of pulses is referred to as a first pulse P1, a negative pulse (second polarity pulse) following the first pulse P1 is referred to as a second pulse P2, and a positive pulse following the second pulse P2 is referred to as a third pulse P3. Although the pulse signal P is assumed in the present embodiment to include a pulse train of "positive pulse-negative pulse-positive pulse," the polarity (positive/negative) and the number of pulses constituting the pulse train are not limited thereto, and are optional.

The power generation unit 110 is configured to generate a power supply voltage VDD required for operation of each unit of the ignition control apparatus 100, from voltages of the first pulse P1 and the third pulse P3 which are positive pulses among the pulses included in the pulse signal P to be induced in the primary side coil L1 of the ignition coil 200. Here, the power generation unit 110 may be configured to be integrated with the control unit 140.

The positive pulse signal detection unit 120 is configured to detect the first pulse P1 and the third pulse P3 from the pulse signal P induced in the primary side coil L1 of the ignition coil 200 and outputs a positive pulse signal PP. The positive pulse signal PP includes a first pulse P1' and a third pulse P3' (FIGS. 5 to 8) corresponding respectively to the first pulse P1 and the third pulse P3 which are included in the pulse signal P. The negative pulse signal detection unit 130 is configured to detect from the pulse signal P induced to the primary side coil L1 of the ignition coil 200, a second pulse P2 following the first pulse P1, and outputs a negative pulse signal PN. The negative pulse signal PN includes a second pulse P2' corresponding to the second pulse P2 included in the pulse signal P (FIGS. 5 to 8).

In the present embodiment, the pulse signal P to be induced in the ignition coil 200 is used primarily as a trigger for a process related to the ignition control. To such an extent, the first pulse P1', the second pulse P2', and the third pulse P3' are respectively equivalent to the first pulse P1, the second pulse P2, and the third pulse P3, which are included in the pulse signal P. For this reason, hereinafter, unless particularly indicated, the first pulse P1 and the first pulse P1' are referred to as "first pulse P1," the second pulse P2 and the second pulse P2' are referred to as "second pulse P2," the third pulse P3 and the third pulse P3' are referred to as "third pulse P3," and no distinction will be made therebetween. As to the power generation unit 110, however, the first pulse P1 and the third pulse P3 represent positive pulses included in the pulse signal P to be induced in the ignition coil 200.

The control unit 140 is configured to generate an ignition control signal F for controlling the switch element 160 in accordance with the rotational speed of the internal combustion engine. It is assumed in the present embodiment that the control unit 140 is implemented by, for example, a microcomputer (abbreviation of a micro-computer), and functions of the control unit 140 have been implemented by software for the micro-computer. However, the present embodiment is not limited to this example, the functions of the control unit 140 may be implemented by hardware, and an implementing method thereof is optional. The control unit 140 acquires a rotational speed of the internal combustion engine in response to the first pulse P1, and determines whether the rotational speed of the internal combustion engine is equal to or greater than a predetermined value, thereby performing ignition control in accordance with the rotational speed. In the present embodiment, the above predetermined value represents a lower limit value of the rotational speed during high-speed rotation. This lower limit value can be optionally set in accordance with the characteristics of the internal combustion engine. Additionally, the above predetermined value is not limited to the lower limit value of the rotational speed during the high-speed rotation, and can optionally be set as long as the ignition operation is stabilized during the high speed rotation. If the rotational speed of the internal combustion engine is equal to or greater than the predetermined value, that is, if the rotational speed is high speed, the control unit 140 acquires a timing of discharging the ignition coil 200 in accordance with the rotational speed, and outputs an ignition control signal F for controlling the switch element 160 so as to energize the ignition coil 200 in response to the second pulse P2 following the first pulse P1, and discharge the ignition coil 200 based on the above discharge timing acquired in response to the first pulse P1. The ignition control signal F is output to the driver unit 150. Here, the above-described positive pulse signal detection unit 120 and the above-described negative pulse signal detection unit 130 may be configured to be integrated with the control unit 140.

The driver unit 150 is a buffer to drive the switch element 160 based on the ignition control signal F received from the control unit 140 and is configured to output to a control terminal of the switch element 160, a drive signal D for turning on or off the switch element 160 in accordance with a signal level of the ignition control signal F. Here, the driver unit 150 may be configured to be integrated with the control unit 140.

The switch element 160 is configured to be driven by the driver unit 150 and energize and discharge the ignition coil 200. In the present embodiment, energization of the ignition coil 200 means flowing current through the primary side coil L1 based on a voltage induced in the primary side coil L1. Additionally, discharge of the ignition coil 200 means blocking current flowing in the primary side coil L1. In the present embodiment, the switch element 160 is an npn-type transistor, an emitter of the npn-type transistor is connected to the positive terminal of the primary side coil L1 of the ignition coil 200, and a collector of the npn-type transistor is connected to the negative terminal of the primary side coil L1 of the ignition coil 200. Additionally, a base of the npn-type transistor, which forms a control terminal of the switch element 160, is connected to an output unit of the driver unit 150, and a drive signal D is applied thereto from the driver unit 150. When the switch element 160 is turned on based on the drive signal D, the primary side coil L1 of the ignition coil 200 is energized. When the switch element 160 is turned off, the primary side coil L1 of the ignition coil 200 is discharged, and the energization is terminated. In other words, the energization and discharge of the ignition coil 200 is controlled in accordance with on and off of the switch element 160. Here, not only the npn-type transistor, but also any device may be used as the switch element 160.

Figure 2:
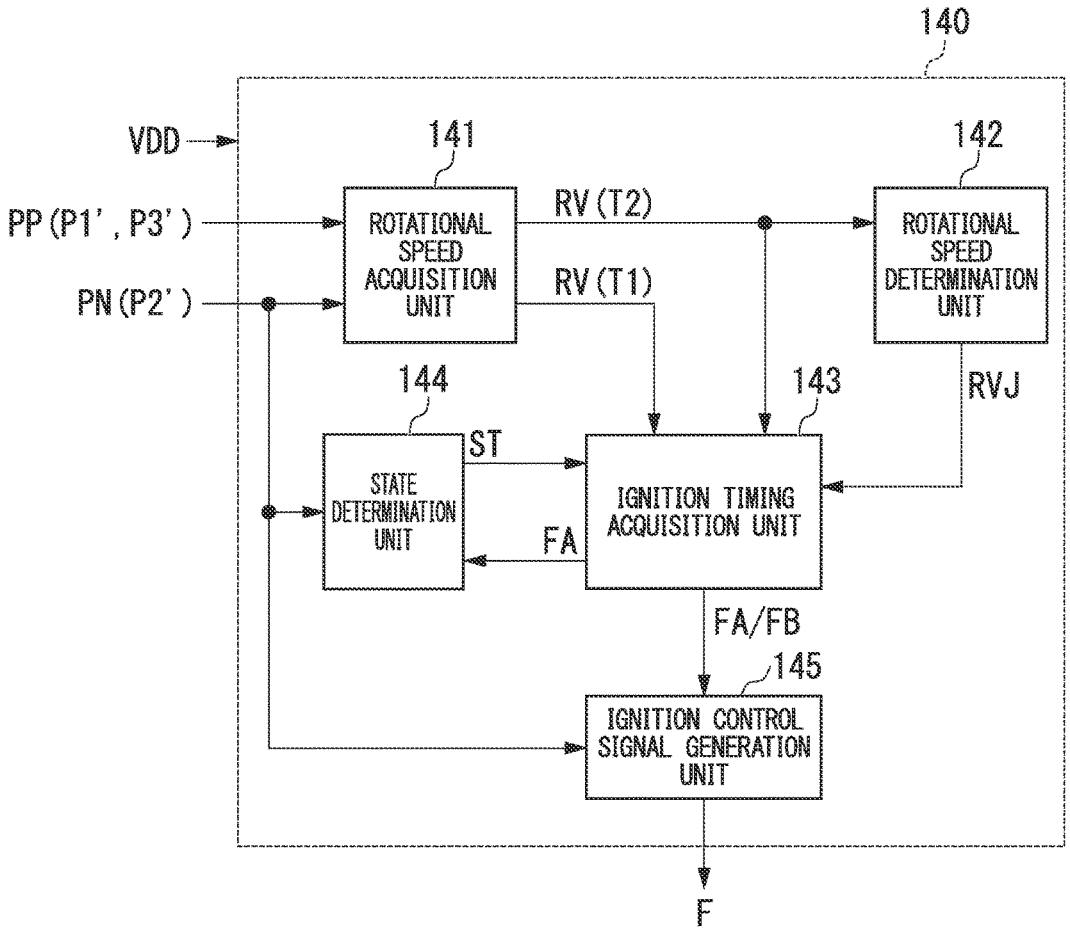
FIG. 2 is a block diagram schematically showing an example of a configuration of a control unit included in the ignition control apparatus according to the embodiment of the present invention.

FIG. 2 is a block diagram schematically showing an example of a configuration of the control unit 140.

The control unit 140 includes a rotational speed acquisition unit 141, a rotational speed determination unit 142, an ignition timing acquisition unit 143, a state determination unit 144, and an ignition control signal generation unit 145.

Among these elements, the rotational speed acquisition unit 141 is configured to acquire a rotational speed RV of the internal combustion engine from the positive pulse signal PP including the first pulse P1 detected by the positive pulse signal detection unit 120. The rotational speed determination unit 142 is configured to determine whether or not the rotational speed RV of the internal combustion engine acquired by the rotational speed acquisition unit 141 is equal to or greater than the above-described predetermined value, and output a result of the speed determination RVJ. The ignition timing acquisition unit 143 is configured to, in a case where a result of the speed determination RVJ by the rotational speed determination unit 142 is positive, that is, in a case where the rotational speed RV is equal to or greater than the predetermined value, acquire a timing of discharging the ignition coil 200 based on the first pulse P1 included in the positive pulse signal PP, and output ignition timing data FA indicating that timing.

The state determination unit 144 is configured to, in a case where a result of the speed determination RVJ by the rotational speed determination unit 142 is positive, that is, the rotational speed RV is equal to or greater than the predetermined value, and the rotation of the internal combustion engine is high-speed rotation, determine in response to the second pulse P2, a chronological state between the energization timing and the discharge timing of the ignition coil 200, and output a result of the state determination ST. Specifically, the state determination unit 144 determines whether a current state is a state in which the energization timing and the discharge timing of the ignition coil 200 are reversed, or a state in which these timings are conflicting. In the present embodiment, the state in which the energization timing and the discharge timing of the ignition coil 200 are reversed means a state in which the discharge timing is before the energization timing. Additionally, the state in which the energization timing and the discharge timing of the ignition coil 200 are conflicting means a state in which it is impossible to determine whether the energization timing is before or after the discharge timing. In the present embodiment, the state in which the energization timing and the discharge timing of the ignition coil 200 are conflicting means a state in which the discharge timing has come within a period for a process for performing energization, and thereby the control unit 140 cannot perform the process for determining whether the energization timing is before or after the discharge timing, until after the process for performing the energization is complete. An example of the state in which the energization timing and the discharge timing are conflicting is a state in which the energization timing and the discharge timing match each other, or are close to each other. However, such a state is not limited to this example, and may be any state as long as it is a state in which it is impossible to determine whether the energization timing is before or after the discharge timing.

The state determination unit 144 performs the above-mentioned determination of the state of timings using a flag of a micro-computer (ignition control flag, or compare interrupt factor flag). The details thereof will be described later.

In a case where a result of the state determination ST by the state determination unit 144 is negative, that is, in a case where the energization timing and the discharge timing are not reversed, nor conflicting, the ignition timing acquisition unit 143 maintains and outputs the above-described discharge timing acquired based on the first pulse P1. In contrast, in a case where a result of the state determination ST by the state determination unit 144 is positive, that is, in a case where the energization timing and the discharge timing are reversed, or conflicting, the ignition timing acquisition unit 143 newly acquired a predetermined timing after the above-described positive determination, in place of the above-described discharge timing acquired based on the first pulse P1, and outputs ignition timing data FB indicating the acquired predetermined timing. In the present embodiment, in a case where it is determined that the energization timing and the discharge timing are reversed, or conflicting, the ignition timing acquisition unit 143 of the control unit 140 acquires as the predetermined timing, a timing at or after the trailing edge of the second pulse P2. However, the predetermined timing is not limited to this example, and may be optionally set in accordance with the characteristics of the internal combustion engine or the like, as long as the predetermined timing is after it is determined that the energization timing and the discharge timing are reversed, or conflicting.

The ignition control signal generation unit 145 is configured to generate an ignition control signal F for controlling energization and discharge of the ignition coil 200 through the switch element 160. Specifically, the ignition control signal generation unit 145 generates an ignition control signal F, basically, so as to to initiate energization of the ignition coil 200 in response to the second pulse P2 (P2') included in the negative pulse signal PN, and terminate the energization of the ignition coil 200 based on the timing indicated by the ignition timing data FA or ignition timing data FB received from the ignition timing acquisition unit 143. However, in the present embodiment, in a case where the discharge timing and the energization timing are reversed, and thereby the above-described discharge timing has come before a determination by the state determination unit 144, or in a case where the discharge timing and the energization timing are conflicting, the ignition control signal generation unit 146 generates an ignition control signal F so as to initiate energization of the ignition coil 200 at the above-described discharge timing. Therefore, in a case where the energization timing and the discharge timing are reversed, energization of the ignition coil 200 is performed before the second pulse P2 is generated. Additionally, in a case where the discharge timing and the energization timing are conflicting, energization of the ignition coil 200 is performed immediately after the second pulse P2 is generated. Further, the signal level of the ignition control signal F becomes a low level at the timing of initiating energization of the ignition coil 200, and becomes a high level at the timing of terminating the energization of the ignition coil 200 based on the ignition timing data output from the ignition timing reacquisition unit 145. In other words, while the ignition control signal F is at the low level, the ignition coil 200 is energized. However, such a signal level of the ignition control signal F is an example for explanation, and may be optionally set in accordance with the electrical characteristics of the driver unit 150 and the switch element 160 which are on the latter stage.

Also, as described later, in a case where a result of the speed determination RVJ by the rotational speed determination unit 142 is negative, that is, in a case where the rotational speed RV of the internal combustion engine is smaller than the above-described predetermined value, the control unit 140 generates and outputs an ignition control signal F so as to energize and discharge the ignition coil 200 in response to the second pulse P2 included in the positive pulse signal PP. In other words, in this case, both energization and discharge of the ignition coil 200 are controlled in response to the second pulse P2. However, without being limited to this example, it is also possible to control either one or both of energization and discharge in accordance with the first pulse P1.

[Description of Operation]

Next, operation of the ignition control apparatus 100 according to the present embodiment will be described.

When an internal combustion engine to which the ignition control apparatus 100 is applied initiates rotating, as shown in FIGS. 5 to 8, the pulse signal P including the pulse train of pulses "first pulse P1 (positive pulse)-second pulse P2 (negative pulse)-third pulse P3 (positive pulse)" is induced in the primary side coil L1 of the ignition coil 200. The power generation unit 110 generates a power supply voltage VDD using the first pulse P1 and the third pulse P3 which are positive pulses among the pulses included in the pulse signal P induced in the ignition coil 200. Then, the power generation unit 110 supplies the power supply voltage VDD to the positive pulse signal detection unit 120, the negative pulse signal detection unit 130, the control unit 140, and the driver unit 150.

The power supply voltage VDD is the voltage generated using the first pulse P1 and the third pulse P3. For this reason, as shown in FIGS. 5 to 8, after the first pulse P1 and the third pulse P3 disappear, the power supply voltage VDD gradually decreases over time, but is a voltage sufficient for the control unit 140 and the like to operate in each rotation cycle.

The positive pulse signal detection unit 120 and the negative pulse signal detection unit 130 operate with the power supply voltage VDD to be supplied from the power generation unit 110. Additionally, the positive pulse signal detection unit 120 and the negative pulse signal detection unit 130 respectively generate a positive pulse signal PP and a negative pulse signal PN from the pulse signal P. In other words, the positive pulse signal detection unit 120 detects from the pulse signal P, the first pulse P1 and the third pulse P3 that are positive pulses. Then, the positive pulse signal detection unit 120 generates a positive pulse signal PP including a first pulse P1' and a third pulse P3' corresponding respectively to the first pulse P1 and the third pulse P3, and outputs the generated positive pulse signal PP to the control unit 140. Additionally, the negative pulse signal detection unit 130 detects from the pulse signal P, the second pulse P2 that is a negative pulse. Then, the negative pulse signal detection unit 130 generates a negative pulse signal PN including a second pulse P2' corresponding to the second pulse P2, and outputs the generated negative pulse signal PN to the section 140.

The control unit 140 operates with the power supply voltage VDD supplied from the power generation unit 110. Schematically, the control unit 140 acquires a timing of discharging the ignition coil 200 in response to the first pulse P1' included in the positive pulse signal PP. Additionally, the control unit 140 acquires a timing of energizing the ignition coil 200 in response to the second pulse P2'. In accordance with these timings, the control unit 140 controls energization and discharge of the ignition coil 200. In this control, the control unit 140 performs a first process for acquiring the timing of discharging the ignition coil 200 in response to the first pulse P1' of the positive pulse signal PP corresponding to the first pulse P1 of the pulse signals P. Additionally, in the above-described control, the control unit 140 performs a second process for energizing the primary side coil of the ignition coil 200 in response to the second pulse P2' of the negative pulse signal PN corresponding to the second pulse P2 following the first pulse P1, and discharging the ignition coil 200 based on the discharge timing acquired in response to the first pulse P1'.

The first process to be performed by the control unit 140 will be described along a flowchart shown in FIG. 3.

Figure 3:
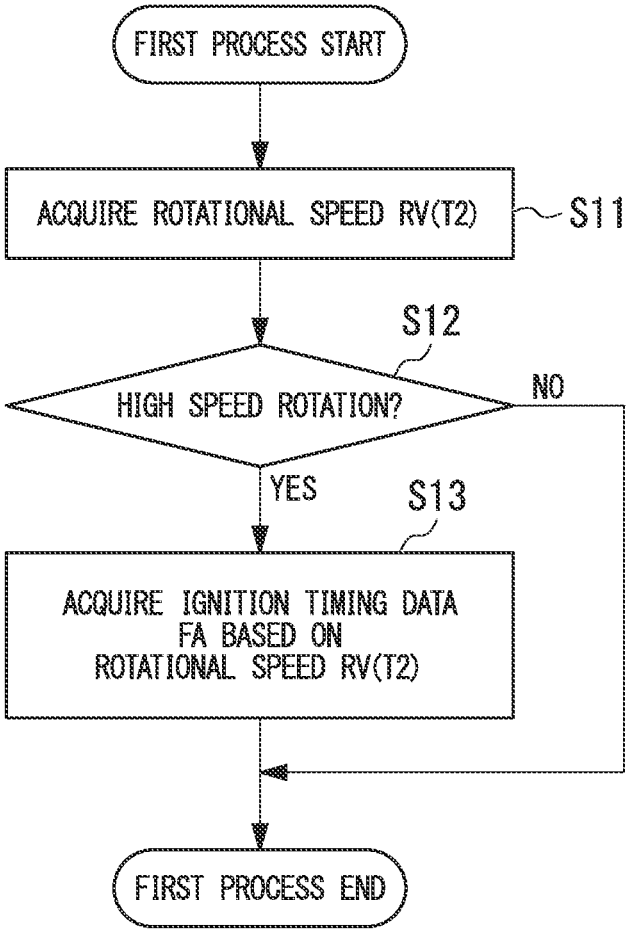
FIG. 3 is a flowchart showing a flow of an operation (first process) of the ignition control apparatus according to the embodiment of the present invention.

FIG. 3 is a flowchart showing a flow of the first process to be performed by the control unit 140. In step S11, the rotational speed acquisition unit 141 constituting the control unit 140 acquires a rotational speed RV of the internal combustion engine. In the present embodiment, the rotational speed acquisition unit 141 acquires as the rotational speed RV, a time interval T2 of the first pulse P1' (P1) shown in FIGS. 5 to 8, that is, a time interval (period) from a rise of the first pulse P1' (P1) in the previous rotation cycle of the internal combustion engine to a rise of the first pulse P1' (P1) in the current rotation cycle. Generally, the rotational speed of the internal combustion engine is represented by revolutions per minute. However, the rotational speed of the internal combustion engine has a correspondence relationship with the time interval T2 of the first pulse P1' (P1). For this reason, in the present embodiment, the rotational speed acquisition unit 141 acquires the time interval T2 of the first pulse P1' (P1), as the rotational speed RV of the internal combustion engine. Hereinafter, the rotational speed RV represented by the time interval T2 is referred to as the "rotational speed RV (T2)."

Subsequently, in step S12, the rotational speed determination unit 142 of the control unit 140 determines from the rotational speed RV (T2) acquired by the rotational speed acquisition unit 141, whether the rotation of the internal combustion engine is high-speed rotation. Specifically, the rotational speed determination unit 142 compares the rotational speed RV (T2) to the above-described predetermined value indicating the lower limit value of the rotational speed at high-speed rotation. If the rotational speed RV (T2) is equal to or greater than the predetermined value, the rotational speed determination unit 142 determines that the rotation of the internal combustion engine is high-speed rotation (step S12: YES).

Figure 5:
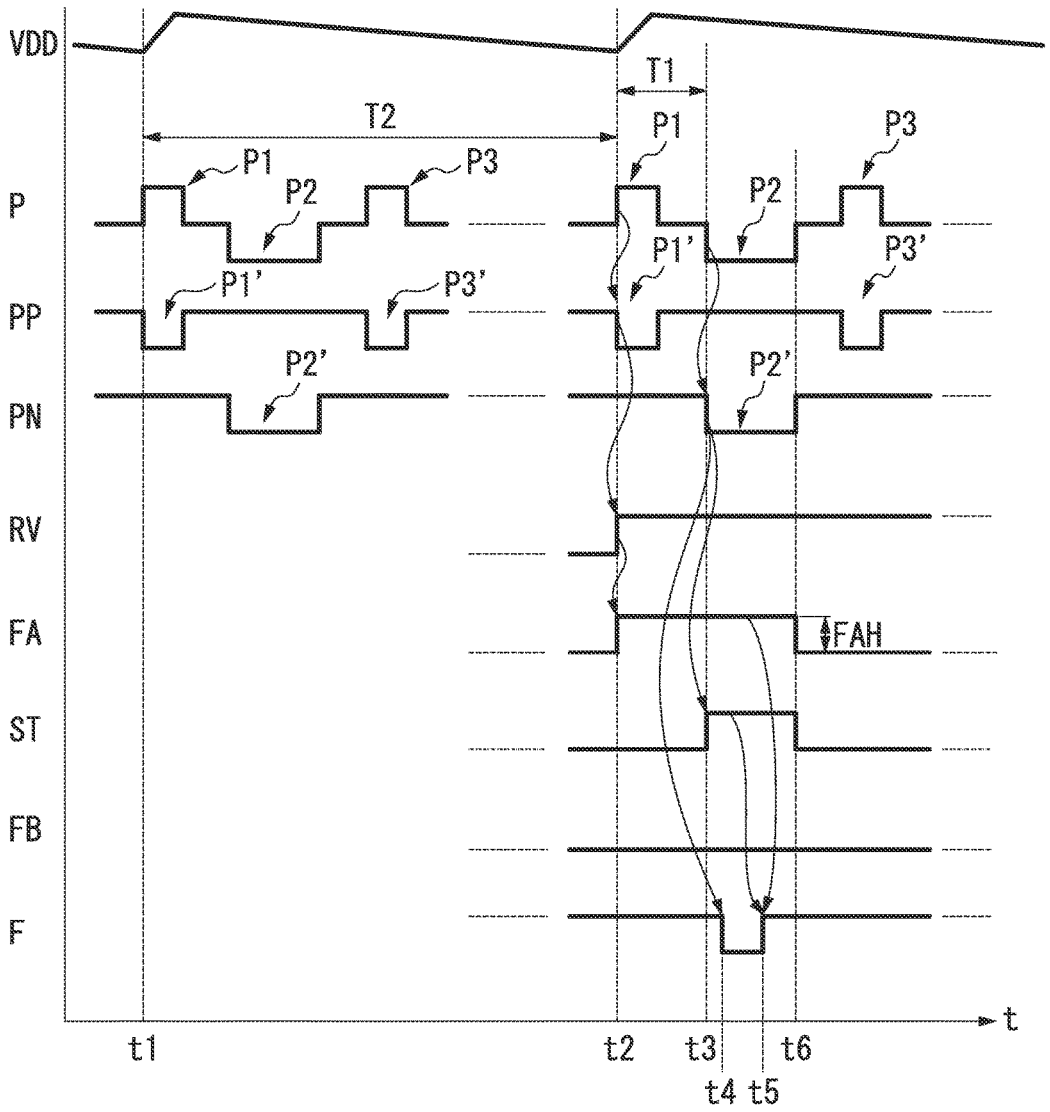
FIG. 5 is a timing chart illustrating an operation (operation at high speed rotation) of the ignition control apparatus according to the embodiment of the present invention.

If the rotation of the internal combustion engine is high-speed rotation (step S12: YES), in step S13, the ignition timing acquisition unit 143 constituting the control unit 140 acquires ignition timing data FA, based on the rotational speed of RV (T2), in response to the first pulse P1' included in the positive pulse signal PP, and outputs the acquired ignition timing data FA to the ignition control signal generation unit 145. In the present embodiment, the ignition timing data FA is data representing a timing of discharging the ignition coil 200 with reference to the first pulse P1' (P1), that is, a desired ignition timing, which is data representing a period, shown in FIG. 5, from time t2 corresponding to the rising of the first pulse P1' to ignition time t5. In FIG. 5, for convenience of description, the period from the time t2 to the ignition time t5 is schematically represented by a height FAH of a waveform representing the ignition timing data FA, and the ignition timing data FA is data representing the period from the time t2 to the ignition time t5. The ignition timing data FA is appropriately set in accordance with the rotational speed RV (T2). For example, the ignition timing data FA have been tabulated in association with the rotational speed RV (T2), so that the ignition timing acquisition unit 143 refers to the table based on the rotational speed RV (T2) to acquire the ignition timing data FA.

The ignition timing data FA is set such that as the rotational speed RV (T2) increases, the period shown in FIG. 5 from time t2 corresponding to the rising of the first pulse P1' (P1) to the ignition time t5 becomes shortened. Conversely, the ignition timing data FA is set such that as the rotational speed RV (T2) decreases, the period shown in FIG. 5 from time t2 corresponding to the rising of the first pulse P1' (P1) to the ignition time t5 becomes longer. Such a correspondence relationship between the ignition timing data FA and the rotational speed RV (T2) can optionally be set, thus making it possible to appropriately set an ignition timing in association with the rotational speed RV (T2) of the internal combustion engine. Therefore, it becomes possible to stabilize the ignition operation as compared to the case of setting an ignition timing by a circuit constant as in the above-described prior art.

In the present embodiment, when the ignition timing data FA is acquired, "1" is set as a value of an ignition control flag of the micro-computer constituting the control unit 140, and a value indicated by the timing data FA is set to an ignition timer of the micro-computer for designating an ignition timing. The value of the above-described ignition control flag is reset to "0" in a case where a timer value of the ignition timer reaches the value indicated by the ignition timing data FA. Therefore, it is possible to recognize from the value of the ignition control flag, whether ignition has been performed. Specifically, if the value of the ignition control flag is "0", it is recognized that the discharge timing has already come, and the ignition has already been performed.

If it is determined in above-described step S12 that the rotation of the internal combustion engine is not high-speed rotation (step S12: NO), that is, if the rotation of the internal combustion engine is low-speed rotation, the first process is terminated without performing the process in above-described step S13. Here, in this case, the value of the ignition control flag of the micro-computer constituting the control unit 140 is "0."

Eventually, according to the first process, only in the case where the rotation of the internal combustion engine is the high-speed rotation, the ignition timing data FA is acquired based on the rotational speed RV (T2), in response to the first pulse P1' (P1) included in the positive pulse signal PP.

Next, a second process to be performed by the control unit 140 will be described along a flowchart shown in FIG. 4.

Figure 4:
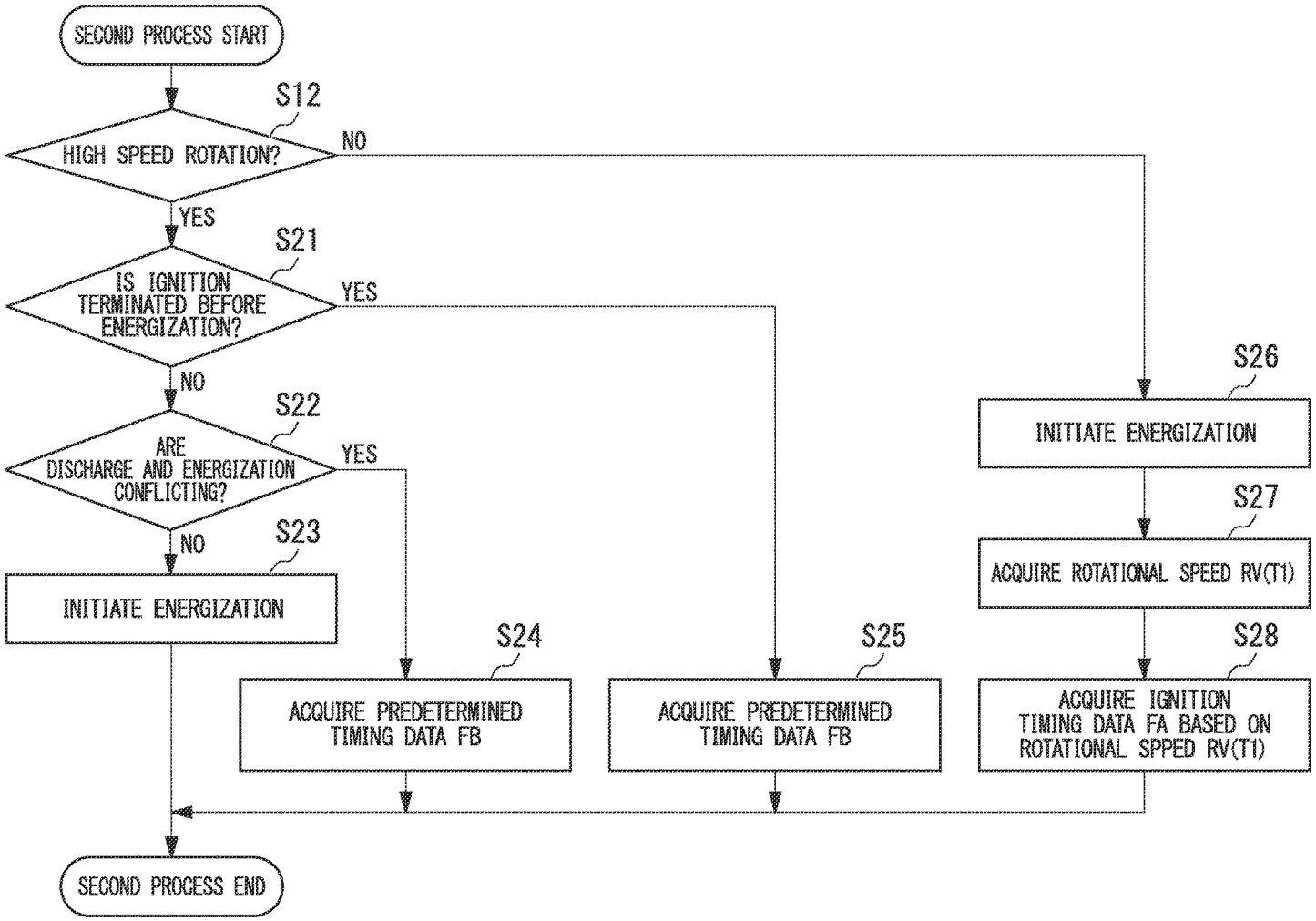
FIG. 4 is a flowchart showing a flow of an operation (second process) of the ignition control apparatus according to the embodiment of the present invention.

FIG. 4 is a flowchart showing a flow of the second process to be performed by the control unit 140. Depending on the rotational speed RV (T2) and the ignition timing data FA of the internal combustion engine which are acquired in the above-described first process, the second process includes processes related to the following four types of controls A to D.

- Control A: control in a case where the rotation of the internal combustion engine is the high-speed rotation and the order of the ignition timing and the energization timing is normal (S12: YES~S21: NO~S22: NO~S23).
- Control B: control in a case where the rotation of the internal combustion engine is the high-speed rotation and the order of the ignition timing and the energization timing is reversed (S12: YES~S21: YES~S25).
- Control C: control in a case where the rotation of the internal combustion engine is the high-speed rotation and the order of the ignition timing and the energization timing is conflicting (S12: YES~S21: NO~S22: YES~S24).
- Control D: control in a case where the rotation of the internal combustion engine is the low-speed rotation (step S12: NO~S26~S27~S28).

Hereinafter, the controls A to D will be described sequentially.

[Control A]

Operation of the control unit 140 related to the control A will be described with reference to a timing chart shown in FIG. 5. FIG. 5 is a timing chart illustrating the operation of the ignition controller 100, which is a timing chart illustrating control operation of the control unit 140 in the case where the rotation of the internal combustion engine is the high-speed rotation, and the order of the energization timing and the ignition timing is normal.

Under a situation where the control A is performed, in step S12 for the above-mentioned first process, in response to the first pulse P1' (P1) included in the positive pulse signal PP, at time t2, the rotational speed determination unit 142 determines that the rotation of the internal combustion engine is the high-speed rotation (step S12: YES). In this case, in step S13 for the above-mentioned first process, the ignition timing acquisition unit 143 acquires the ignition timing data FA, and outputs the ignition timing data FA to the ignition control signal generation unit 145.

Subsequently, in step S21, in response to the second pulse P2' (P2) included in the positive pulse signal PP, at time t3, the state determination unit 144 constituting the control unit 140 determines whether or not ignition has been terminated before energization. In other words, the control unit 140 determines whether the timing of energizing the ignition coil 200 to be performed in response to the second pulse P2' (P2) and the timing of discharging the ignition coil 200 indicated by the ignition timing data FA acquired in the above-described first process are reversed. In a case where the timing of discharging the ignition coil 200 indicated by the ignition timing data FA is after the timing of energizing the ignition coil 200, the control unit 140 determines that the discharge timing and the energizing timing of the ignition coil 200 are not reversed. In a case where the timing of discharging the ignition coil 200 is before the above-described energizing timing, the control unit 140 determines that the discharge timing and the energizing timing of the ignition coil 200 are reversed.

In the present embodiment, the determination of whether or not the energizing timing and the discharge timing of the ignition coil 200 are reversed can be performed not by directly comparing these timings, but by, for example, using an ignition control flag of the micro-computer constituting the control unit 140. In other words, the state determination unit 144 can determine whether or not ignition has been completed before energization, from a value of the ignition control flag of the micro-computer which is set at the time of the acquisition of the ignition timing data FA in the above-described first process. It is assumed under the control A that the order of the energization timing and the discharge timing is normal. For this reason, a value of the ignition control flag at time t3 is kept "1" that is the value set in the first process. Therefore, it is understood from this value that the ignition has not been completed before energization. Accordingly, if a value of the ignition control flag of the microcomputer is kept "1" at time t3, the state determination unit 144 determines in step S21 that the ignition has not been completed before energization (step S21: NO).

Subsequently, in step S22, the state determination unit 144 determines whether or not the discharge timing indicated by the ignition timing data FA acquired by the ignition timing acquisition unit 143 and the timing of energization to be performed in response to the second pulse P2' (P2) included in the negative pulse signal PN are conflicting. With respect to this determination method, as described next, it possible to determine whether a conflict of the timings is occurring, using a value of the compare interrupt factor flag (flag for an interrupt process) of the micro-computer constituting the control unit 140. A value of the compare interrupt factor flag is set to "1" when a request for the ignition process occurs at the discharge timing indicated by the value of the ignition timing data FA (height FAH shown in FIG. 5). When a predetermined time has elapsed thereafter, the value of the compare interrupt factor flag is reset to "0." At this time, the value of the above-described ignition control flag, as well as the value of the compare interrupt factor flag, are also reset to "0."

In a case where a value of the compare interrupt factor flag for controlling discharge of the ignition coil 200 is "1" in the processing period for the control unit 140 to control initiation of energization of the ignition coil 200 in response to the second pulse P2' (P2), the state determination unit 144 determines that the timing of discharging the ignition coil 200 and the energization timing are conflicting (step S22: YES). Specifically, in a case where a value of the ignition control flag is "1," and a value of the compare interrupt factor flag is "1," the state determination unit 144 determines that the timing of energizing the ignition coil 200 and the discharge timing are conflicting, and that it cannot be determined whether the energization timing is before or after the discharge timing.

Here, it is assumed under the control A that the order of the energization timing and the discharge timing is normal, and a request for the ignition process does not occur at time t3. For this reason, at the time the state determination unit 144 determines in response to the second pulse P2' (P2) which of the timings is earlier, a value of the compare interrupt factor flag is "0," and a value of the ignition control flag is "1." In this case, the state determination unit 144 negatively determines that the energization timing and the discharge timing are not conflicting (step S22: NO). Additionally, the state determination unit 144 outputs to the ignition timing acquisition unit 143, a state determination result ST indicating the above result. Upon receiving the state determination result ST, the ignition timing acquisition unit 143 maintains and outputs the ignition timing data FA output to the ignition control signal generation unit 145 in the above-described first process.

Subsequently, in step S23, in response to the second pulse P2' (P2) included in the negative pulse signal PN, the ignition control signal generation unit 145 generates, at time t3, an ignition control signal F so as to initiate energization of the ignition coil 200 at time t4. Upon receiving the ignition control signal F, the driver unit 150 shown in FIG. 1 outputs a high level as the drive signal D, and turns on the switch element 160. Thus, the primary side coil L1 of the ignition coil 200 is energized. Although operation up to the initiation of energization of the ignition coil 200 is performed in the second process, thereafter, the ignition control signal generation unit 145 generates an ignition control signal F so as to discharge the ignition coil 200 and thus terminate the energization at time t5 corresponding to the discharge timing indicated by the ignition timing data FA received from the ignition timing acquisition unit 143. Upon receiving the ignition control signal F, the driver unit 150 shown in FIG. 1 outputs a low level as the drive signal D, and turns off the switch element 160. Thereby, the primary side coil L1 of the ignition coil 200 is discharged to terminate the energization, and then ignition is performed. Thus, in a case where the determination results in step S21 and step S22 are both negative, that is, in a case where ignition has not been completed before energization, and the energization timing and the discharge timing are not conflicting, the ignition coil 200 is discharged to terminate the energization, based on the ignition timing data FA acquired in response to the first pulse P1. The termination of the energization triggers performance of ignition.

As described above, according to the control A, energization is initiated in response to the second pulse P2, and termination of the energization (ignition) is controlled in accordance with the ignition timing acquired in response to the first pulse P1.

[Control B]

Figure 6:
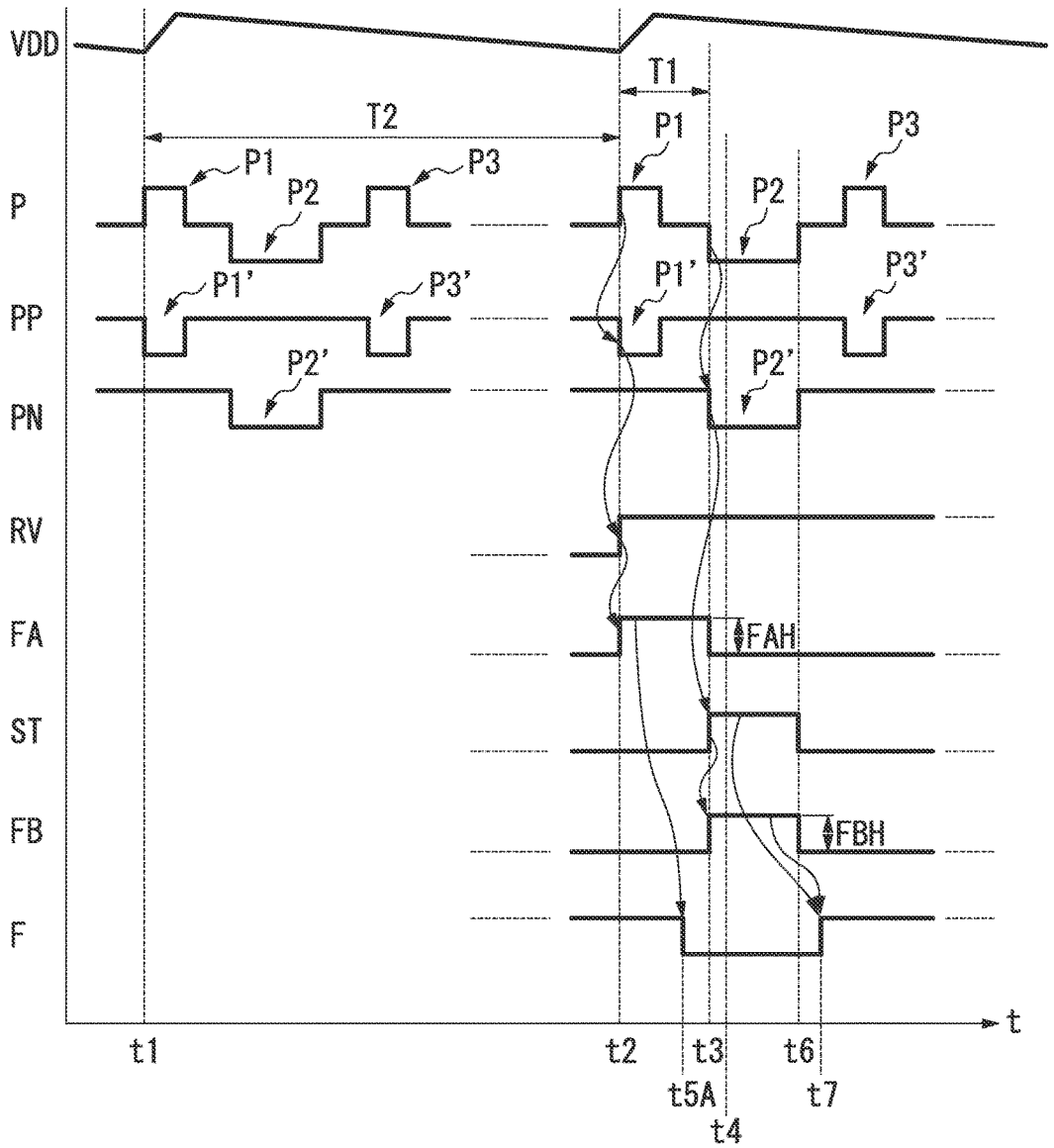
FIG. 6 is a timing chart illustrating an operation (operation at high speed rotation where timings are reversed) of the ignition control apparatus according to the embodiment of the present invention.

Next, operation of the control unit 140 related to the control B will be described with reference to a timing chart shown in FIG. 6. FIG. 6 is a timing chart illustrating the operation of the ignition control apparatus 100, which is a timing chart illustrating control operation of the control unit 140 in a case where the rotation of the internal combustion engine is the high-speed rotation, and the order of the energization timing and the discharge timing is reversed. Such a reversal of the timings is likely to occur due to, for example, a rapid decrease in rotational speed of the internal combustion engine. The operation under the control B corresponds to the operation in the case where it is determined in step S21 of the above-described control A that the energization timing and the discharge timing are completely reversed, that is, the operation in the case where the discharge timing indicated by the ignition timing data FA has come before time t3.

In the present embodiment, in a case where the order of the discharge timing and the energization timing is reversed, and ignition is terminated before energization, that is, in a case where the discharge timing has come before the energization, the ignition control signal generation unit 145 generates and outputs an ignition control signal F so as to initiate energization at the discharge timing indicated by the value of the ignition timing data FA (height FAH shown in FIG. 6) acquired in the above-described first process. In FIG. 6, ignition is completed at time t5A before time t3 corresponding to the original energization timing, and energization is initiated at time t5A. It is assumed under the control B that the order of the discharge timing and the energization timing is reversed. For this reason, energization is initiated at time t5A before time t3, and at time t5A, the value of the ignition control flag of the micro-computer is reset to "0."

In above-described step S21, in response to the second pulse P2' (P2) included in the negative pulse signal PN at time t3, the state determination unit 144 constituting the control unit 140 determines at time t4 whether or not the ignition has been completed before energization. In the present embodiment, the state determination unit 144 determines at time t4 whether the ignition has been completed before energization, from the value of the ignition control flag of the micro-computer set in the above-described first process. Specifically, in a case where the value of the ignition control flag is "0" at the time t4, the state determination unit 144 determines in step S21 that the ignition has been completed before energization (step S21: YES), and outputs a state determination result ST indicating that result. In this case, a value of the compare interrupt factor flag is irrelevant. Upon receiving this state determination result ST, the ignition timing acquisition unit 143 newly acquires in step S25, for example, a predetermined timing after the trailing edge of the second pulse P2 that is the negative pulse, in place of the ignition timing data FA output in the first process. Additionally, the ignition timing acquisition unit 143 outputs ignition timing data FB indicating the predetermined timing.

In the present embodiment, the ignition timing data FB is data representing a timing of discharging the ignition coil 200 based on time t4 at which it is determined from the value of the ignition control flag whether or not the ignition has been completed before energization, and is also data representing a time period, shown in FIG. 6, from time t4 to ignition time t7 corresponding to the predetermined timing. In FIG. 6, similar to the above-described ignition timing data FA, for convenience of explanation, a height FBH of a waveform representing the ignition timing data FB schematically represents the time period from time t4 to ignition time t7. As described above, the predetermined timing can be optionally set in accordance with the characteristics of the internal combustion engine, as long as the predetermined timing is after it is determined whether the timing of discharging the ignition coil 200 and the energization timing are reversed or conflicting.

The ignition control signal generation unit 145 generate an ignition control signal F so as to discharge the ignition coil 200 to terminate the energization at time t7 corresponding to the predetermined timing indicated by the value of the ignition timing data FB (height FBH shown in FIG. 6) received from the ignition timing acquisition unit 143. Upon receiving the ignition control signal F, the driver unit 150 shown in FIG. 1 outputs a low level as the drive signal D, and turns off the switch element 160. Thereby, the primary side coil L1 of the ignition coil 200 is discharged, and thus the energization is terminated.

Thus, under the control B, in a case where ignition has been completed before energization, the energization is initiated at the ignition terminated timing. Then, regardless of the rotational speed RV, energization of the primary side coil L1 of the ignition coil 200 is terminated at the predetermined timing, and ignition is forcibly performed. Here, in the present embodiment, the above-described predetermined timing is set at or after the trailing edge of the second pulse P2. For this reason, the energization of the primary side coil L1 of the ignition coil 200 is terminated in a state where energy is released from the ignition coil 200. Therefore, even if the energization of the primary side coil L1 is terminated, discharge required for ignition does not occur, thereby making it possible to prevent an unstable ignition operation due to the residual energy of the ignition coil 200.

As described above, according to the control B, in the case where the discharge timing acquired in response to the first pulse P1 in the first process and the energization timing are reversed, the ignition coil 200 is discharged to terminate the energization at the predetermined timing newly acquired in response to the second pulse P2.

[Control C]

Figure 7:
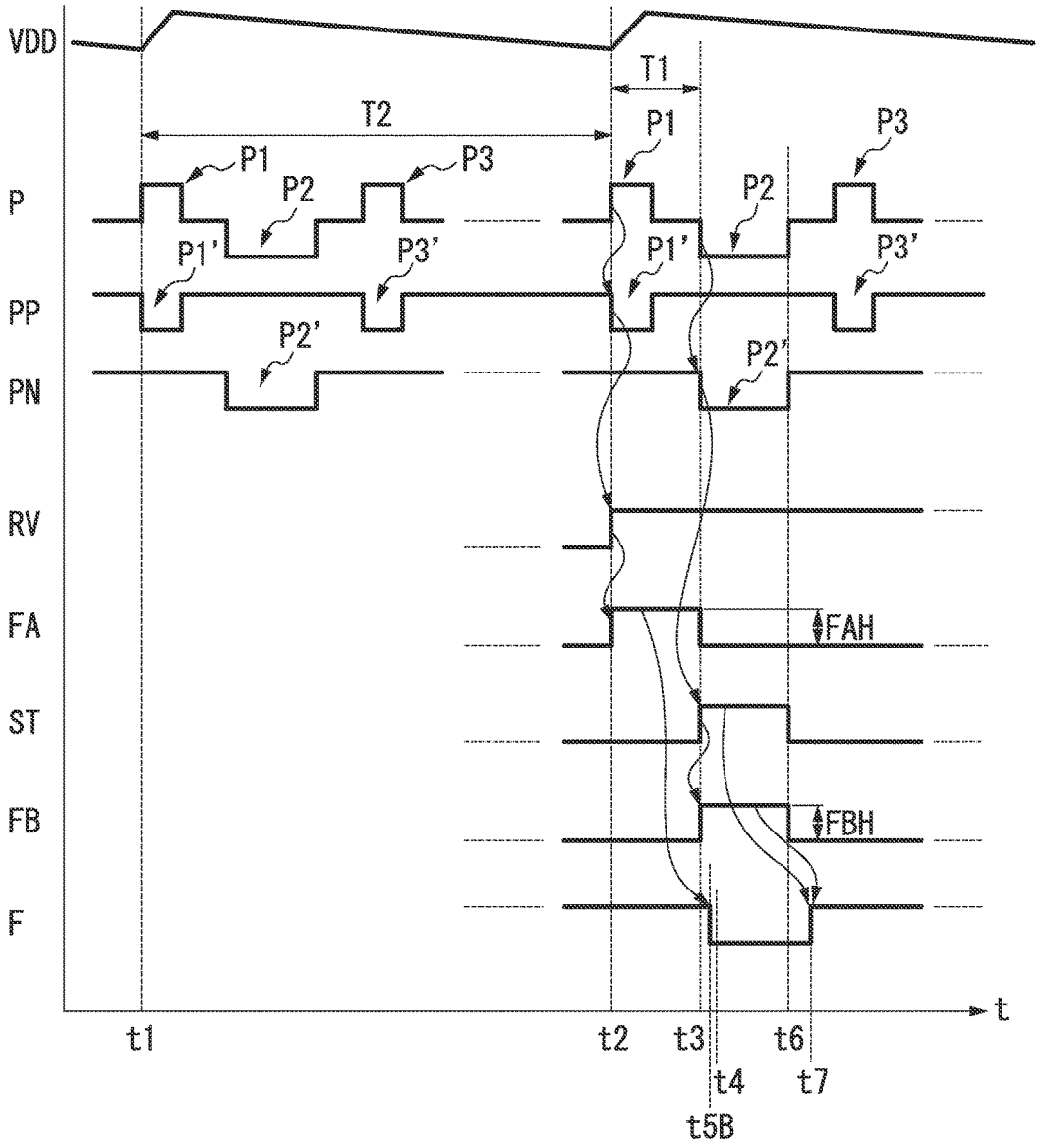
FIG. 7 is a timing chart illustrating an operation (operation at high speed where timings are conflicting) of the ignition control apparatus according to the embodiment of the present invention.

Next, operation of the control unit 140 related to the control C will be described with reference to a timing chart shown in FIG. 7. FIG. 7 is a timing chart illustrating the operation of the ignition control apparatus 100, which is a timing chart illustrating control operation in a case where the rotation of the internal combustion engine is the high-speed rotation, and the order of the energization timing and the discharge timing is conflicting. Such a conflict of the timings is likely to be caused by, for example, a gradual decrease in rotational speed of the internal combustion engine. The operation under the control C corresponds to the operation in the case where it is determined in step S22 of the above-described control A that the energization timing and the discharge timing are conflicting, that is, the operation in the case where time t5B corresponding to the discharge timing designated by the ignition timing data FA matches or is close to the energization timing. In the example of FIG. 7, ignition time t5B designated by the ignition timing data FA is included in a energization processing period that is after time t3 corresponding to the leading edge of the second pulse P2 serving as the trigger for the second process and before time t4 at which energization is initiated.

In above-described step S22, in response to the second pulse P2' (P2), the state determination unit 144 constituting the control unit 140 determines at time t4 whether or not the energization timing and the discharge timing are conflicting. For example, it is possible to determine whether or not the ignition timing and the energization timing are conflicting, from respective values of the ignition control flag and the compare interrupt factor flag of the micro-computer constituting the control unit 140. It is assumed under the control C that the energization timing and the discharge timing are conflicting. For this reason, ignition has been completed at time t4, the value of the ignition control flag is kept "1," and a value of the compare interrupt factor flag is also set to "1" at time t4. It is recognized from the respective values of the ignition control flag and the compare interrupt factor flag that the energization timing and the discharge timing are conflicting. In this case, the state determination unit 144 determines in step S22 that the energization timing and the discharge timing are conflicting at time t4 (step S22: YES), and outputs a state determination result ST indicating that result. Upon receiving the state determination result ST, similarly to the above-described control B, the ignition control signal generation unit 145 generates and outputs an ignition control signal F so as to initiate energization at time t5B corresponding to the discharge timing indicated by the value of the ignition timing data FA (height FAH shown in FIG. 7) acquired in the first process.

Subsequently, similarly to the above-described control B, in step S24, the ignition timing acquisition unit 143 newly generates and outputs, in place of the ignition timing data FA, ignition timing data FB indicating a predetermined timing that is after it is determined that the energization timing and the discharge timing are conflicting. Additionally, in response to the second pulse P2' (P2), the ignition control signal generation unit 145 generates and outputs an ignition control signal F so as to discharge the ignition coil 200 to terminate the energization at time t7 corresponding to the predetermined timing indicated by the value of the ignition timing data FB (height FBH shown in FIG. 7) received from the ignition timing acquisition unit 143.

As described above, according to the control C, in the case where the discharge timing acquired in response to the first pulse P1' (P1) and the energization timing are conflicting, similarly to the control B, energization is initiated at the time the conflict of the timings is determined, and at a subsequent predetermined timing, the energization of the ignition coil 200 is terminated.

[Control D]

Figure 8:
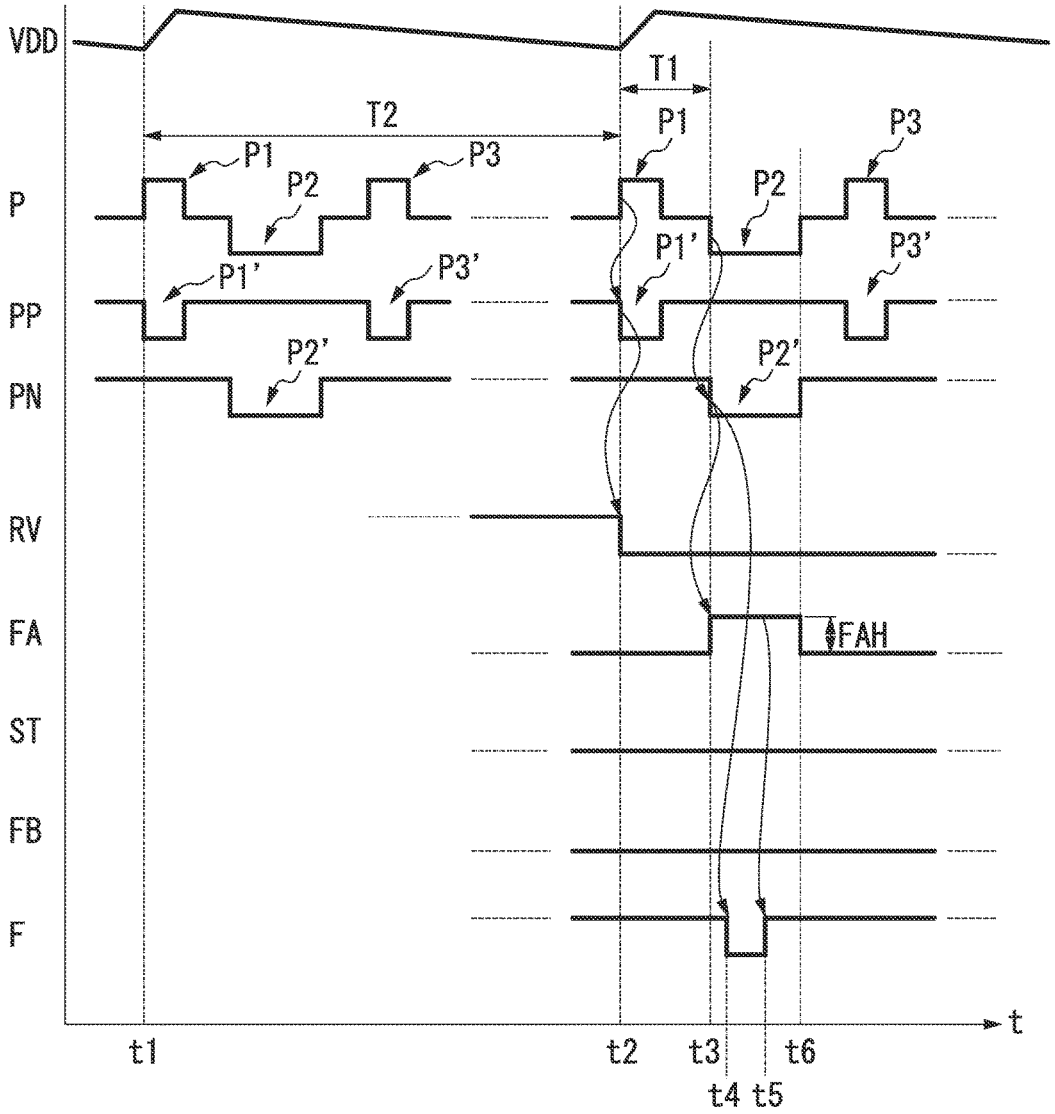
FIG. 8 is a timing chart illustrating an operation (operation at low speed rotation) of the ignition control apparatus according to the embodiment of the present invention.

Next, operation of the control unit 140 related to the control D will be described with reference to a timing chart shown in FIG. 8. FIG. 8 is a timing chart illustrating operation of the ignition controller 100, which is a timing chart illustrating control operation in a case where the rotation of the internal combustion engine is the low-speed rotation. Operation under the control D corresponds to the operation in the case where it is determined in above-described step S12 that the rotation of the internal combustion engine is not the high-speed rotation (step S12: NO), that is, the operation in the case where it is determined that the rotation of the internal combustion engine is the low-speed rotation.

Under a situation where the control D is performed, in step S12 in the above-described first process, in response to the first pulse P1 included the positive pulse PP, the rotational speed determination unit 142 acquires, at the time t2, a rotational speed RV (T2) of the internal combustion engine from the time interval T2 of the first pulse P1 (P1'). The rotational speed determination unit 142 determines from the rotational speed RV (T2) that the rotation of the internal combustion engine is not the high-speed rotation (step S12: NO).

Subsequently, in response to the second pulse P2' (P2), the ignition control signal generation unit 146 generates, in step S26, an ignition control signal F having a signal level for initiating energization of the ignition coil 200 at time t4, and has the energization of the ignition coil 200 initiated by the switch element 160.

Subsequently, in step S27, in response to the second pulse P2' (P2) included in the negative pulse signal PN at time t3, the rotational speed acquisition unit 141 acquires, as the rotational speed RV, a time interval T1 between the first pulse P1' (P1) included in the pulse signal PP and the second pulse P2' (P2) included in the negative pulse signal PN (i.e., a time period from the rising of the first pulse P1' to the rising of the second pulse P2'). Hereinafter, the rotational speed RV represented by the time interval T1 is referred to as the "rotational speed RV (T1)." Subsequently, in step S28, the ignition timing acquisition unit 143 acquires ignition timing data FA in accordance with the rotational speed RV (T1), and outputs the ignition timing data FA to the ignition timing acquisition unit 143. The ignition timing data FA in this case is data representing an ignition timing previously set in accordance with the rotational speed RV of the internal combustion engine represented by the rotational speed RV (T1).

Subsequently, in response to the second pulse P2' included in the negative pulse signal PN, the ignition control signal generation unit 145 generates an ignition control signal F having a signal level for discharging the ignition coil 200 to terminate the energization at time t5 designated by the value of the ignition timing data FA (height FAH shown in FIG. 8) received from the ignition timing acquisition unit 143.

As described above, according to the control D, the energization timing and the discharge timing of the ignition coil 200 are acquired in response to the second pulse P2, and energization and discharge of the ignition coil 200 are controlled.

Next, the determination operation of the state determination unit 144 will be supplementally described.

Figure 9:
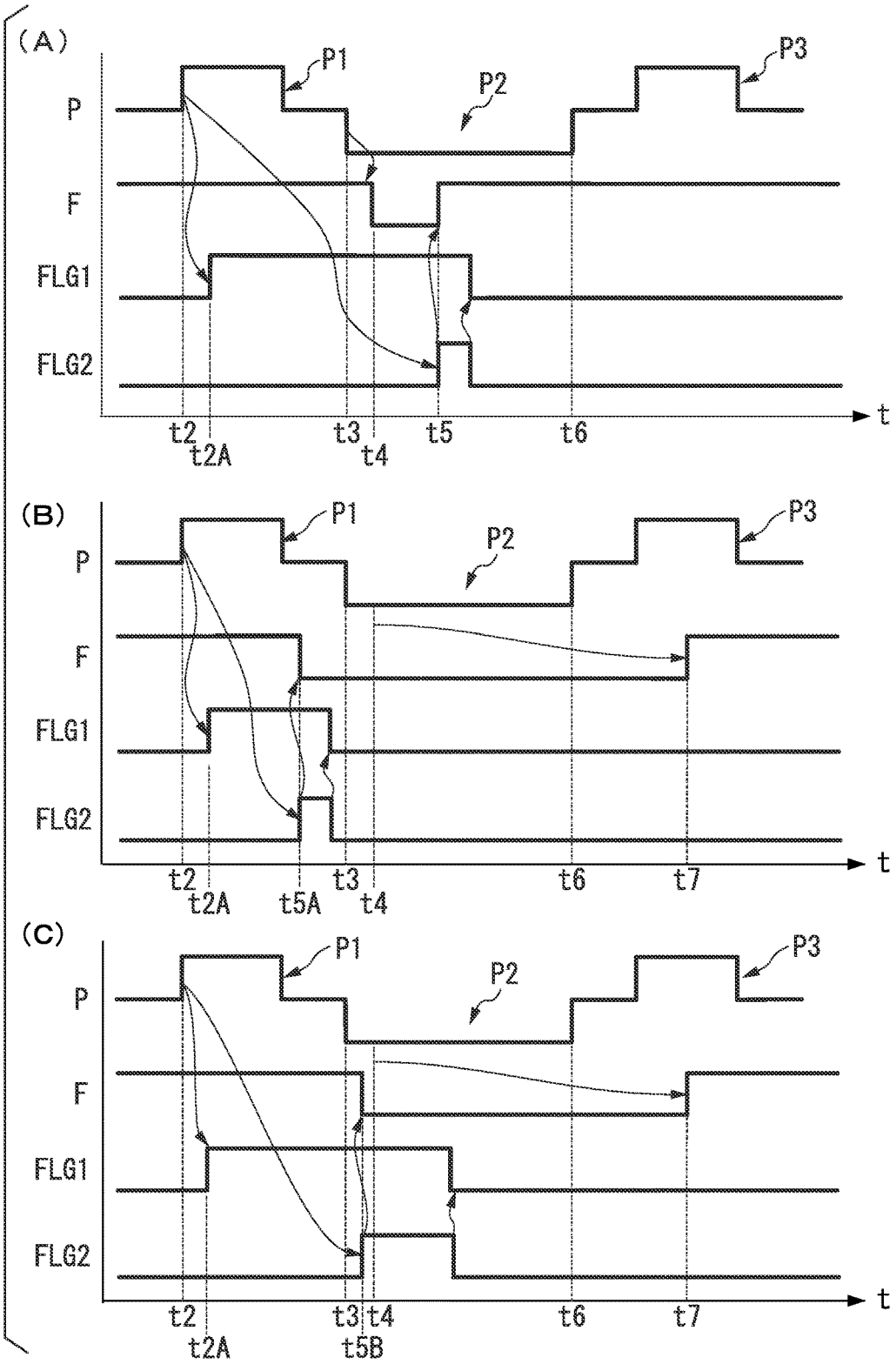
FIG. 9 is a diagram supplementally illustrating an operation of a state determination unit included in the ignition control apparatus according to the embodiment of the present invention.

FIG. 9 is a diagram supplementally illustrating the operation of the state determination unit 144.

FIG. 9(A) is a diagram showing an example of a relationship under the above-described control A (situation where reversal and conflict of timings do not occur at the high-speed rotation) among the pulse signal P, the ignition control signal F, the ignition control flag FLG1, and the compare interrupt factor flag FLG2. In other words, FIG. 9(A) is a diagram supplementally illustrating the operation of the state determination unit 144 described with reference to FIG. 5. As shown in FIG. 9(A), under the control A, when the discharge timing is set at time t2 in response to the first pulse P1 in the above-described first process, a value of the ignition control flag FLG1 is set to "1" at time t2A. Thereafter, when the discharge timing set in the first process has come at time t5, a value of the compare interrupt factor flag FLG2 is set to "1," and when a given time has passed thereafter, the value of the compare interrupt factor flag FLG2 is reset to "0." At this time, the value of the ignition control flag FLG1, as well as the compare interrupt factor flag FLG2, are reset to "0".

Here, near the front edge of the second pulse P2 (near time t3) at which the determination by the state determination unit 144 (steps S21, S22) is performed, the value of the ignition control flag FLG1 is "1," and the value of the compare interrupt factor flag FLG2 is "0." Such a combination of values of the respective flags under the control A differs from a combination of values of the respective flags under a later-described control B or control C under which it is assumed that a reversal or conflict of timings occurs. For this reason, it is possible for the state determination unit 144 to determine from the values of the ignition control flag FLG1 and the compare interrupt factor flag FLG2, that the above-described reversal and conflict of the timings are not occurring.

FIG. 9(B) is a diagram showing an example of a relationship under the above-described control B (situation where a reversal of the timings occurs at the high-speed rotation) among the pulse signal P, the ignition control signal F, the ignition control flags FLG1, and the compare interrupt factor flag FLG2. In other words, FIG. 9(B) is a diagram supplementally illustrating the operation of the state determination unit 144 described with reference to FIG. 6. As shown in FIG. 9(B), also under the control B, similarly to the control A, in response to the first pulse P1, a value of the ignition control flag FLG1 is set to be "1" at time t2A. Then, when the discharge timing has come at time t5A, a value of the compare interrupt factor flag FLG2 is set to "1." Here, under the control B, when the value of the compare interrupt factor flag FLG2 is set to "1" at time t5A, the signal level of the ignition control signal F is set to the low level, thereby initiating energization. Additionally, when a given time has elapsed from the time the value of the compare interrupt factor flag FLG2 is set to "1," the value of this compare interrupt factor flag FLG2 is reset to "0." In this case, the value of the ignition control flag FLG1 is also reset to "0."

Here, at time t4 at which the determination by the state determination unit 144 (step S21) is performed, the value of the ignition control flag FLG1 is "0," and the value of the compare interrupt factor flag FLG2 is also "0." Such a combination of values of the respective flags under the control B differs from a combination of values of the respective flags under the above-described control A or a later-described control C. For this reason, it is possible for the state determination unit 144 to determine from the respective values of the ignition control flag FLG1 and the compare interrupt factor flag FLG2, that the above-described reversal of the timings is occurring. After this determination, an ignition control signal F is generated so as to discharge the ignition coil 200 at time t7 corresponding to the predetermined timing indicated by the value of the ignition timing data FB.

Here, at time t4 at which the determination by the state determination unit 144 (step S21) is performed, the value of the ignition control flag FLG1 becomes "0" only in a case where a reversal of the timings occurs. Therefore, under the control B, it is possible to determine that a reversal of the timings occurs, only from the value of the ignition control flags FLG1, without reference to the value of the compare interrupt factor flag FLG2. In the above description of the operation with reference to FIG. 6, the reversal of the timings is determined only from the value of the ignition control flag FLG1.

FIG. 9(C) is a diagram showing an example of a relationship under the above-described control C (situation where a reversal of the timings occurs at the high-speed rotation) among the pulse signal P, the ignition control signal F, the ignition control flag FLG1, and the compare interrupt factor flag FLG2. In other words, FIG. 9(C) is a diagram supplementally illustrating the operation of the state determination unit 144 described with reference to FIG. 7. As shown in FIG. 9(C), also under the control C, similarly to the control A, in response to the first pulse P1, a value of the ignition control flag FLG1 is set to "1" at time t2A. Then, when the discharge timing has come at time t5B that is between time t3 and time t4 during which the above-described second process is being performed, a value of the compare interrupt factor flag FLG2 is set to "1," and thus energization is initiated.

Here, at time t4 at which the determination by the state determination unit 144 (step S22) is performed, the value of the ignition control flag FLG1 is "1," and the value of the compare interrupt factor flag FLG2 is also "1." Such a combination of values of the respective flags under the control C differs from the combination of values of the respective flags under the above-described control A and control B. For this reason, it is possible for the state determination unit 144 to determine that a conflict of the above-described timings is occurring, from the values of the ignition control flag FLG1 and the compare interrupt factor flag FLG2. After this determination, an ignition timing data FB is generated so as to discharge the ignition coil 200 at time t7 corresponding to the predetermined timing indicated by the value of the ignition control signal FB.

According to the controls A to C among the above-described controls A to D, in the case where the rotational speed RV of the internal combustion engine is high-speed, the ignition timing data is acquired in response to the first pulse P1' included in the positive pulse signal PP, and energization is initiated in response to the second pulse P2' included in the negative pulse signal PN. For this reason, there arises a temporal margin from the time the rotational speed of the internal combustion engine is detected to the time ignition is performed. Thereby, it is possible to, even at the high-speed rotation, secure a processing time for acquiring the ignition timing data in accordance with the rotational speed RV. Accordingly, it is possible to stabilize the ignition operation at the high-speed rotation.

Additionally, according to the control B and the control C, whether the discharge timing and the energization timing of the ignition coil 200 are reversed or conflicting is determined to acquire the timing data FA and FB. For this reason, it is possible to continuously perform the ignition operation even in a case where the rotational speed of the internal combustion engine is abruptly changed, thereby making it possible to stabilize the ignition operation.

Further, according to the control D, in the case where the rotational speed of the engine is low-speed, energization and discharge of the ignition coil 200 are controlled in response to the second pulse P2' temporally close to the discharge timing and the energization timing of the ignition coil 200. For this reason, it is possible to precisely control the ignition timing, thereby making it possible to suppress a variation in ignition timing.

According to the above-described embodiments of the present invention, at the high-speed rotation, the timing of discharging the ignition coil 200 is acquired in response to the first pulse P1' included in the positive pulse signal PP. For this reason, even if the rotational speed of the internal combustion engine increases, it is possible to secure a processing time required to acquire the discharge timing. Therefore, it is possible to stably control the discharge of the ignition coil, and thus stabilize the ignition operation. Additionally, in a case where the rotational speed of the internal combustion engine decreases, each of an ignition timing and an energization timing is set in response to the second pulse P2', thereby making it possible to precisely control the ignition operation at the low-speed rotation.

Although the present invention has been expressed as the ignition control apparatus 100 in the above embodiments, the present invention may be expressed as an ignition control method while focusing on the operation of the ignition control apparatus 100. In this case, an ignition control method according to the present invention is an ignition control method of based on a pulse signal to be induced in an ignition coil along with rotation of the internal combustion engine, causing a voltage to be supplied to a spark plug included in the internal combustion engine, to be generated in an ignition coil. The ignition control method includes at least control steps (steps S11 to S13, S12 to S28) of acquiring a timing of discharging the ignition coil in response to a first pulse of the pulse signal, and energizing the ignition coil in response to a second pulse following the first pulse, while discharging the ignition coil based on the discharge timing acquired in response to the first pulse.

Although the embodiments of the present invention have been described above, the present invention is not limited to the above-described embodiments, and various modifications are possible without departing from the scope of the present invention.

For example, it has been described in the above-described embodiments that the rotational speed RV of the internal combustion engine is acquired from the time interval T2 between the first pulse P1' in the previous rotation cycle and the first pulse P1' in the current rotation cycle, or from the time interval T1 between the first pulse P1' and the second pulse P2' which are in the current rotation period. However, a rotational speed in the current rotation cycle may be predicted from a time interval between any two pulses among the first pulse P1 to third pulse P3 in the previous or last but one rotation cycle, and the rotational speed RV can be acquired from any pulse included in the pulse signal P.

INDUSTRIAL APPLICABILITY

The present invention is applicable to apparatuses and methods for controlling ignition of internal combustion engines.

DESCRIPTION OF REFERENCE NUMERALS

100 ignition control apparatus
110 power generation unit
120 positive pulse signal detection unit
130 negative pulse signal detection unit
140 control unit
141 rotational speed acquisition unit
142 rotational speed determination unit
143 ignition timing acquisition unit
144 state determination unit
145 ignition control signal generation unit
150 driver unit
160 switch element
200 ignition coil
300 spark plug

The invention claimed is:

1. An ignition control apparatus comprising:

a switch element configured to energize and discharge an ignition coil in which a pulse signal is induced along with rotation of an internal combustion engine so as to generate in the ignition coil a voltage supplied to a spark plug of the internal combustion engine, the pulse signal including a first pulse and a second pulse, the second pulse continuously following the first pulse and differing in polarity from the first pulse, the ignition coil including a primary side coil and a secondary side coil, the primary side coil having a first end and a second end lower in voltage level than the first end, the first end and the second end of the primary side coil being respectively connected directly to an emitter and a collector of the switch element, and the secondary side coil being connected to the spark plug; and a control circuit configured to acquire a rotational speed of the internal combustion engine in response to the first pulse, wherein:

the control circuit is configured to, in a first case that the rotational speed is equal to or greater than a first value, acquire, in response to the first pulse, a first timing of discharging the ignition coil, control the switch element so as to energize the ignition coil in response to the second pulse, and discharge the ignition coil at the first timing; and the control circuit is configured to, in a second case that the rotational speed is less than the first value, acquire, in response to the second pulse, a second timing of energizing the ignition coil and a third timing of discharging the ignition coil, and control the switch element to energize the ignition coil at the second timing, and discharge the ignition coil at the third timing.

2. The ignition control apparatus according to claim 1, wherein the control circuit is configured to, in the first case, if a fourth timing of energizing the ignition coil is before the first timing, control the switch element to discharge the ignition coil at the first timing, and if the fourth timing is after the first timing, control the switch element to discharge the ignition coil at a fifth timing different from the first timing.

3. The ignition control apparatus according to claim 1, wherein the control circuit is configured to, in the first case, if the first timing is within a period for controlling energization of the ignition coil, control the switch element to discharge the ignition coil at a sixth timing that is after a trailing edge of the second pulse.

4. The ignition control apparatus according to claim 1, further comprising:

a power generation circuit configured to generate a power supply voltage from the pulse signal, the power supply voltage being required to operate the ignition control apparatus.

5. An ignition control apparatus comprising:

a switch element configured to energize and discharge an ignition coil in which a pulse signal is induced along with rotation of an internal combustion engine so as to generate in the ignition coil a voltage supplied to a spark plug of the internal combustion engine, the pulse signal including a first pulse and a second pulse, the second pulse continuously following the first pulse and differing in polarity from the first pulse, the ignition coil including a primary side coil and a secondary side coil, the primary side coil having a first end and a second end lower in voltage level than the first end, the first end and the second end of the primary side coil being respectively connected directly to an emitter and a collector of the switch element, and the secondary side coil being connected to the spark plug; and a control means for acquiring a rotational speed of the internal combustion engine in response to the first pulse, wherein:

the control means is configured to, in a first case that the rotational speed is equal to or greater than a first value, acquire, in response to the first pulse, a first timing of discharging the ignition coil, control the switch element so as to energize the ignition coil in response to the second pulse, and discharge the ignition coil at the first timing; and the control means is configured to, in a second case that the rotational speed is less than the first value, acquire, in response to the second pulse, a second timing of energizing the ignition coil and a third timing of discharging the ignition coil, control the switch element to energize the ignition coil at the second timing, and discharge the ignition coil at the third timing.

6. The ignition control apparatus according to claim 5, wherein the control means is configured to, in the first case, if a fourth timing of energizing the ignition coil is before the first timing, control the switch element to discharge the ignition coil at the first timing, and if the fourth timing is after the first timing, control the switch element to discharge the ignition coil at a fifth timing different from the first timing.

7. The ignition control apparatus according to claim 5, wherein the control means is configured to, in the first case, if the first timing is within a period for controlling energization of the ignition coil, control the switch element to discharge the ignition coil at a sixth timing that is after a trailing edge of the second pulse.

8. The ignition control apparatus according to claim 5, further comprising:

a power generation circuit configured to generate a power supply voltage from the pulse signal, the power supply voltage being required to operate the ignition control apparatus.

* * * * *